US009845619B2

(12) United States Patent
Bendel et al.

(10) Patent No.: US 9,845,619 B2
(45) Date of Patent: Dec. 19, 2017

(54) LOCK FOR A FLAP OR DOOR

(71) Applicant: Kiekert Aktiengesellschaft, Heiligenhaus (DE)

(72) Inventors: Thorsten Bendel, Oberhausen (DE); Armin Handke, Duisburg (DE); Andreas Sohlbach, Mulheim (DE); Matthais Ochtrop, Dorsten (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 12 days.

(21) Appl. No.: 14/398,777

(22) PCT Filed: May 2, 2013

(86) PCT No.: PCT/DE2013/000244
§ 371 (c)(1),
(2) Date: Nov. 4, 2014

(87) PCT Pub. No.: WO2013/163981
PCT Pub. Date: Nov. 7, 2013

(65) Prior Publication Data

US 2015/0137529 A1 May 21, 2015

(30) Foreign Application Priority Data

May 4, 2012 (DE) ..... 10 2012 207 443

(51) Int. Cl.
*E05C 3/06* (2006.01)
*E05B 61/00* (2006.01)
(Continued)

(52) U.S. Cl.
CPC ..... *E05B 61/00* (2013.01); *E05B 17/0062* (2013.01); *E05B 77/04* (2013.01);
(Continued)

(58) Field of Classification Search
CPC ..... E05B 61/00; E05B 85/24; E05B 17/0062; E05B 77/10; E05B 5/26; E05B 77/04;
(Continued)

(56) References Cited

U.S. PATENT DOCUMENTS 4,221,413 A * 9/1980 Bonnetain ..... B60R 19/18 188/377
4,358,141 A * 11/1982 Hamada ..... E05B 85/243 292/216

(Continued)

FOREIGN PATENT DOCUMENTS

CA 2853863 A1 * 4/2013 ..... E05B 85/26
DE 10 2004 021516 A1 11/2005

(Continued)

OTHER PUBLICATIONS

International Search Report for corresponding patent application No. PCT/DE2013/000244 dated Oct. 16, 2013.

*Primary Examiner* — Kristina R Fulton
*Assistant Examiner* — Faria F Ahmad
(74) *Attorney, Agent, or Firm* — Renner, Otto, Boisselle & Sklar, LLP

(57) ABSTRACT

The invention relates to a lock for a door or flap, comprising a locking mechanism that consists of a rotary latch (1) and at least one pawl (2) for locking the rotary latch (1), the rotary latch (1) when in the detent position preferably initiating an opening moment in the pawl (2). The design of the rotary latch (1) is such that said latch is deformed under excessive stress in the locked state in such a way that an engagement between the pawl (2) and the rotary latch (1) is maintained or increases. A lock of this type will not open even under excessive stress.

20 Claims, 1 Drawing Sheet

(51) Int. Cl.

| | |
|---|---|
| ***E05B 77/04*** | (2014.01) |
| ***E05B 85/26*** | (2014.01) |
| ***E05B 77/10*** | (2014.01) |
| ***E05B 85/24*** | (2014.01) |
| ***E05B 17/00*** | (2006.01) |
| *E05C 3/02* | (2006.01) |
| *E05C 3/04* | (2006.01) |
| *E05C 3/16* | (2006.01) |

(52) U.S. Cl.
CPC ..... *E05B 77/10* (2013.01); *E05B 85/24* (2013.01); *E05B 85/26* (2013.01); *Y10T 292/1075* (2015.04)

(58) Field of Classification Search
CPC .... E05B 85/20; E05B 85/26; E05B 292/1075; E05B 63/0013; E05B 17/0029; E05B 81/00; E05B 65/0007; E05B 77/22; E05B 77/24; E05B 77/245; E05B 77/26; E05B 77/265; E05B 77/30; E05B 85/22; E05B 85/243; E05B 85/245; E05B 85/247; E05B 57/00; Y10T 292/1075; E05C 3/06; E05C 3/08; E05C 3/10; E05C 3/16; E05C 3/162; E05C 3/165; E05C 3/167; E05C 3/04; E05C 3/041; E05C 3/042; E05C 3/043; E05C 3/044; E05C 3/045; E05C 3/046; E05C 3/047; E05C 3/048; E05C 3/145; E05C 17/50; E05C 19/024; E05C 2003/126; E05C 2003/128; E05C 3/00; E05C 3/002; E05C 3/004; E05C 3/006; E05C 3/008; E05C 3/02; E05C 3/12; E05C 3/122; E05C 3/36
USPC ..... 292/195, 200, 201, 210, 216, 194, 292/DIG. 23
See application file for complete search history.

(56) References Cited

U.S. PATENT DOCUMENTS

| | | | | | |
|---|---|---|---|---|---|
| 4,756,564 | A * | 7/1988 | Ikeda | E05B 85/26 | 292/216 |
| 4,783,103 | A * | 11/1988 | Schlegel | E05B 85/26 | 292/216 |
| 5,020,838 | A * | 6/1991 | Fukumoto | E05B 81/14 | 292/201 |
| 5,308,128 | A * | 5/1994 | Portelli | E05B 77/265 | 292/216 |
| 5,454,608 | A * | 10/1995 | Dzurko | E05B 81/90 | 292/216 |
| 5,632,517 | A * | 5/1997 | Paulik | E05B 77/40 | 292/341.12 |
| 5,649,726 | A * | 7/1997 | Rogers, Jr. | E05B 81/06 | 292/201 |
| 6,695,362 | B2 * | 2/2004 | Kluting | E05B 77/02 | 292/216 |
| 7,789,440 | B2 * | 9/2010 | Graute | E05B 85/26 | 292/216 |
| 2003/0020285 | A1 * | 1/2003 | Kluting | E05B 77/02 | 292/216 |
| 2003/0222462 | A1 * | 12/2003 | Bruce | E05B 85/26 | 292/216 |
| 2005/0062295 | A1 * | 3/2005 | Ketelsen | E05B 85/26 | 292/216 |
| 2006/0055181 | A1 * | 3/2006 | Berghahn | E05B 81/20 | 292/216 |
| 2009/0322104 | A1 * | 12/2009 | Nam | E05B 85/243 | 292/216 |
| 2010/0045051 | A1 * | 2/2010 | Berghahn | E05B 81/14 | 292/144 |
| 2010/0052336 | A1 * | 3/2010 | Bendel | E05B 85/26 | 292/196 |
| 2011/0169280 | A1 * | 7/2011 | Scholz | E05B 85/26 | 292/200 |
| 2011/0169282 | A1 * | 7/2011 | Scholz | E05B 85/26 | 292/220 |
| 2014/0049056 | A1 * | 2/2014 | Scholz | E05B 81/14 | 292/200 |
| 2014/0217752 | A1 * | 8/2014 | Lujan | E05B 77/38 | 292/216 |
| 2015/0115626 | A1 * | 4/2015 | Bendel | E05B 85/26 | 292/195 |
| 2015/0115627 | A1 * | 4/2015 | Scholz | E05B 85/26 | 292/195 |
| 2015/0191947 | A1 * | 7/2015 | Philippe | E05B 77/38 | 292/195 |
| 2015/0240536 | A1 * | 8/2015 | Cumbo | E05B 85/20 | 292/200 |
| 2015/0306991 | A1 * | 10/2015 | Ban | B60N 2/01583 | 297/463.1 |
| 2015/0308164 | A1 * | 10/2015 | Bendel | B21D 53/38 | 292/195 |
| 2015/0308166 | A1 * | 10/2015 | Bendel | E05B 77/36 | 292/195 |
| 2015/0315827 | A1 * | 11/2015 | Bendel | E05B 77/36 | 292/195 |

FOREIGN PATENT DOCUMENTS

| | | | | |
|---|---|---|---|---|
| DE | 10 2005 016488 | A1 | 10/2006 | |
| DE | 10 2005 035898 | A1 | 2/2007 | |
| DE | 10 2007 003948 | A1 | 5/2008 | |
| DE | 102010011322 | A1 * | 9/2011 | E05B 85/26 |
| DE | 10 2010 034770 | A1 | 2/2012 | |
| DE | 102012024210 | A1 * | 6/2014 | E05B 85/26 |
| FR | 2 856 718 | A1 | 12/2004 | |
| JP | 2002-213131 | A | 7/2002 | |
| JP | 2003-120102 | A | 4/2003 | |
| JP | 2010-112059 | A | 5/2010 | |
| JP | 2011-168961 | A | 9/2011 | |
| WO | 2011-120482 | A1 | 10/2011 | |

* cited by examiner

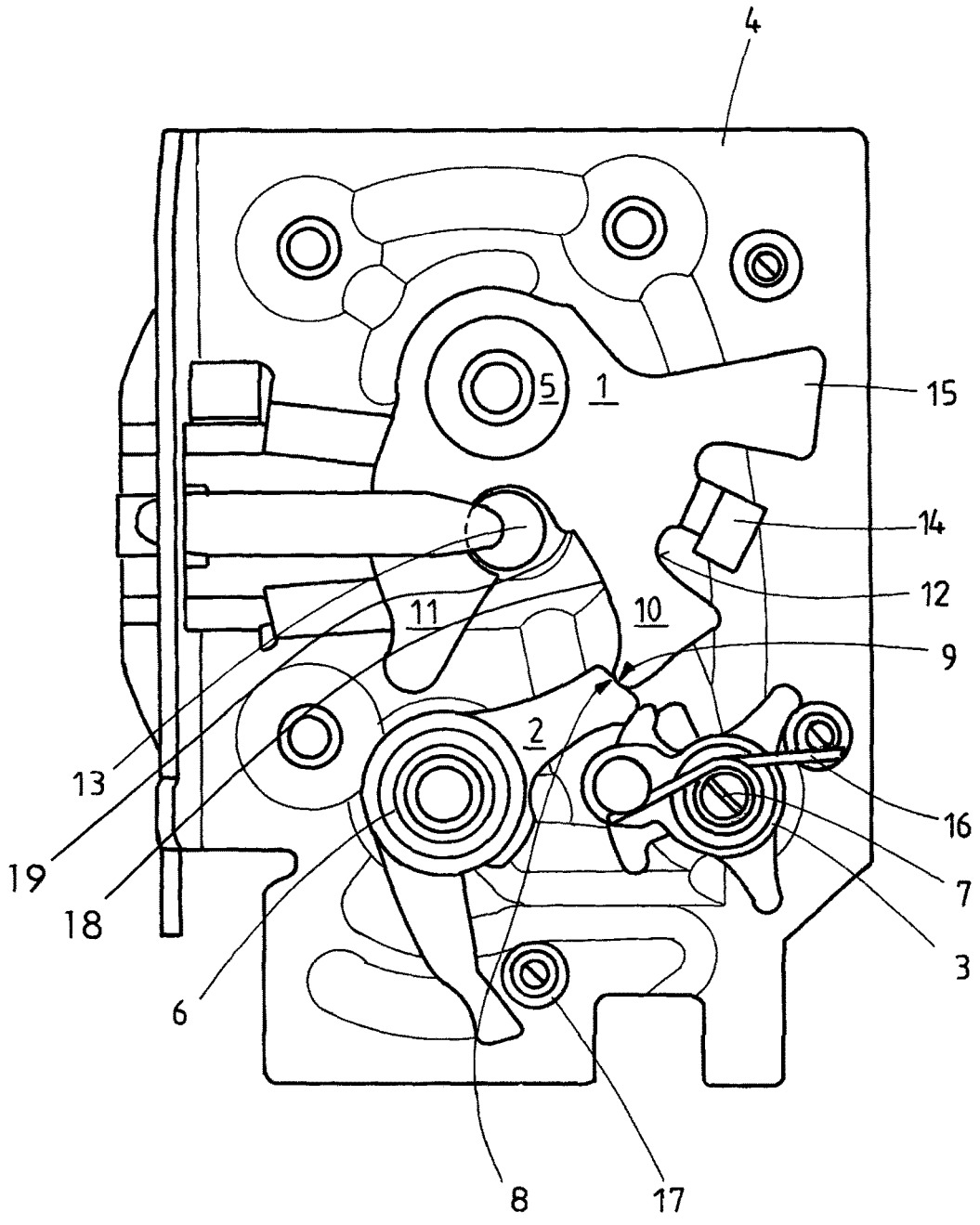
4
5
1
15
14
12
11
10
9
2
13
16
19
7
18
3
6
8
17

LOCK FOR A FLAP OR DOOR

This application is a national phase of International Application No. PCT/DE2013/000244 filed May 2, 2013 and published in the English language, which claims priority to German Patent Application No. DE 10 2012 207 443.0 filed May 4, 2012, which are all hereby incorporated herein by reference in their entirety.

The invention relates to a lock for a flap or a door with the characteristics of the generic part of claim 1. A lock of said design is disclosed in publication DE 10 2008 061 524 A1. The door or flap can be a door or flap of a motor vehicle or of a building.

The aforementioned lock comprises a locking mechanism that contains a rotary latch and at least one pawl with which the rotary latch can be locked in a closed position by locking surfaces of the pawl and rotary latch. Locking surfaces refer to surfaces on the pawl and rotary latch abutting to ensure locking of the locking mechanism and that result in overlapping. In a closed position, the rotary latch can keep a door or flap closed, so that the door or flap cannot be opened. If the rotary latch is in an open position, the locking bolt can leave the locking mechanism and the door and flap can be opened.

A rotary latch contains a load arm and a collecting arm. In case of a locked locking mechanism the load arm prevents a locking bolt of a door or flap from disengaging from the locking mechanism. If a door or flap is closed, the closing bolt is moved against the load arm pivoting it and thus also the rotary latch in the direction of the closed position. The collecting arm can also be referred to as a main load arm. Both terms are used as synonyms below.

Publication DE 10 2010 003 483 A1 discloses a locking mechanism, in which the rotary latch initiates an opening moment in the pawl when the pawl locks the rotary latch in the fully closed position. The rotary latch can for instance initiate such a moment in the pawl as a result of a door sealing pressure and/or due to a pretensioned spring that can turn the rotary latch into its opening position and/or can initiate such a torque in the pawl by opening of a respective door or flap. The pawl can be moved out of its locked position into its detent position by an opening moment. In order to reliably prevent this in the event of a locked locking mechanism, the arrangement also contains a blocking lever that can block the movement of the pawl out of its detent position. To open such a locking mechanism, the blocking lever is moved out of its blocking position with the aid of a release lever. Generally, the opening moment initiated by the rotary latch in the pawl suffices to unlock the locking mechanism, i.e. to open it.

In a locking mechanism with the aforementioned opening moment it can happen for a variety of reasons that the opening moment does not suffice to move the pawl out of its locking position. In order to ensure that the locking mechanism opens also in the event of such a malfunction, a tappet is provided that is, for instance, attached to the release lever and/or the intermediate closed position pawl as disclosed in DE 10 2010 003 483 A1. Such a tappet should move the pawl out of its locking position in particular if the pawl is unable to leave the locking position solely as a result of the opening moment.

In order for the tappet to be able to open the locking mechanism, it must be possible to pivot the tappet arranged, for instance, on the release lever by a sufficiently large angle. In general, an angle of between 20° to 30°, such as approx. 25°, suffices for the pawl to be moved out of its locking position solely by means of the tappet.

A release lever of a locking mechanism is generally moved by actuation of a handle in order to release a locking mechanism. The handle can be an internal door handle or an external door handle of a motor vehicle. Such a handle is generally connected to the release lever via a rod assembly or a Bowden cable in order to move the release lever upon actuation of the handle. Where the rod assembly or the Bowden cable wear out due to ageing, this can also reduce the pivot range by which the release lever can be pivoted by actuation of a handle. It may then not be possible to reliably open the locking mechanism.

The minimum angle by which a pawl and thus also the release lever have to be pivoted in order to be moved fully out of their detent position and thus open a locking mechanism could be reduced by reducing, for instance the locking surface of the pawl and thus the overlap. In this way it is, for instance, possible that a release lever only has to be pivoted by 10°-16°, such as 12°-14° in order to be able to reliably open the locking mechanism. In case of excessive stresses, in particular stresses of 20-30 kN, the locking surface of the rotary latch can become detached from the locking surface of the pawl, resulting in unplanned opening of the locking mechanism. Tests have shown that in a usual locking mechanism neither the rotary latch nor the pawl are notably contorted or deformed. Instead, it is easily apparent that the support points of the axes of the rotary latch and of the pawl as well as the lock plate and lock case on which the locking mechanism is mounted, are deformed. The unplanned opening can be assisted by tolerances in the components of the locking mechanism.

Unless specified differently below, the above characteristics can on their own or in combination be part of the invention.

The aim of the invention is to provide a reliably working lock of the type described above.

The aim of the invention is achieved by a lock with the characteristics of the first claim. Advantageous embodiments are disclosed in the sub claims.

In order to solve this task, a lock for a door or flap comprising a locking mechanism consisting of a rotary latch and at least one pawl is provided for locking the rotary latch. In one embodiment, the rotary latch can initiate an opening moment in the pawl. Alternatively, the rotary latch can also initiate a closing moment in the pawl. Generally, no excessive stresses exist when in the closed state of a door or a flap, no additional external forces (additional to an internal force, such as caused by a door sealing pressure) are initiated in the locking mechanism. Excessive stresses can, in particular, occur in the event of a crash, when considerable forces are initiated in the locking bolt of the door or flap in the opening direction of the door or flap. According to the invention, a locking mechanism is designed in such a way that in case of excessive stressing the rotary latch is deformed in such a way that the rotary latch remains in its detent position and, in particular, due to a predetermined bending point of the rotary latch. The predetermined bending point is preferably provided on the collecting area or the main load arm. Despite of excessive stresses, the overlap of rotary latch and pawl remains. Preferably it even increases.

In one embodiment of the invention, the predetermined bending point is arranged on the collecting arm. The predetermined bending point can also be provided in form of a recess and/or can at least include a recess arranged on the side of the collecting arm facing away from the locking bolt of a door or flap in a locked position of the locking mechanism. A recess refers to an opening in the rotary latch, extending fully through the rotary latch, in other words the recess forms a clearance in the rotary latch. According to the invention a recess can at least be provided in the collecting or main load arm. The collecting arm can, however, also contain two or more recesses.

Preferably, two recesses that are spaced apart are formed or provided in an arm of the rotary latch, facing the lock holder in the closed state of the locking mechanism. In a further preferred embodiment, an elevation or an arm is provided in the area of the rotary latch, situated between the recesses that can be used for locking the locking mechanism in the intermediate closed position. A first recess, facing the rotary latch, can be used to define the position of a predetermined bending point, preferably on the collecting arm. This allows, for instance, changing of the predetermined bending point depending on the depth of the first recess in the rotary latch, i.e. a radial extension of the recess in direction of a pivot point of the rotary latch. The position of the predetermined bending point can also influence the overlap between rotary latch and pawl. Where, for instance, a recess extending deep into the rotary latch from its outer edge is inserted in the rotary latch, the depth of the recess determines the position of the predetermined bending point.

In the event of the locking mechanism being excessively stressed, such as in the event of an accident, the locking mechanism may not be released. The rotary latch and pawl must remain engaged. This can be positively assisted by the provision of a predetermined bending point in the rotary latch as disclosed in the invention. Where part of the rotary latch buckles over the predetermined bending point, the point of engagement between the rotary latch and pawl moves in the direction of a greater overlap, i.e. a release is not only prevented but the locking mechanism is also additionally secured. This clearly shows that as a result of the position of the predetermined bending point, a relative movement in the area of the point of engagement between the rotary latch and the pawl is controllable in the event of excessive stresses. In other words, the invention allows influencing of the overlap between rotary latch and pawl in the event of high or excessive stressing.

A deep recess in the rotary latch produces a long lever arm and thus an enlargement of an overlap when exposed to stressing. Lever arm refers to the distance between the position of the bending point (predetermined bending point) and the point of engagement between the rotary latch and pawl. Even in case of a minor, i.e. smaller recess in the rotary latch, the overlap is also increased. The shorter lever arm does, however, result in less movement of the point of engagement between the rotary latch and pawl towards creating a greater overlap.

A second recess spaced apart from the first recess can advantageously reduce the weight of the rotary latch and/or can positively influence the bending behavior. There is also the option of arranging the recess in the rotary latch in such a way that the reshaped material also functions as a stop for an intermediate closed position of the locking mechanism.

The predetermined bending point can be realized through changed material properties (elasticity), thickness, reduced bending stiffness, reduction of cross section and/or a reduction of stability. The material can, for instance, have become weaker at a predetermined point as a result of retrospective processing, in order to provide a predetermined bending point in this way. The material thickness can be reduced at one point, in order to achieve a predetermined bending point at a desired point. It is, for instance, possible that material properties are changed at a point or in an area in order to provide a predetermined bending point. This can, for instance, be achieved by heat treatment with areas of greater or less hardness being produced in the rotary latch. When excessive stresses are applied to the lock and thus the locking mechanism as, for instance, in case of an accident, the area with the reduced hardness acts as a predetermined bending point, without the locking mechanism being released. By choosing a favorable position of the predetermined bending point, the overlap is preferably increased, ensuring a particular reliable locking of the locking mechanisms.

Alternatively or in combination with changed material properties, the rotary latch and preferably the collecting arm can contain a reduced cross section. A reduced cross section can be provided on one or both sides of the rotary latch. A reduction on both sides offers the advantage of a symmetric design of the rotary latch and can also positively influence a potential deformation of the rotary latch. It is also possible that the rotary latch contains two or more reductions in cross section in order to define a predetermined bending point and to specifically influence a bending behavior of the predetermined bending point. One or several recesses of different lengths can also be provided along the rotary latch. Several recesses can, for instance, be provided, forming continuously increasing lengths or increasing and then decreasing lengths in the rotary latch.

In one embodiment of the invention, recesses can be molded, stamped and/or applied to the rotary latch by machining. At least partial reductions in thickness of the rotary latch are also regarded as recesses. A recess or recesses can, for instance, also be milled or stamped into the rotary latch.

In another embodiment, the recesses can contain a cross section that can be described as a continuous radius and/or U-shape and/or a pointed notch. Using the shape of the cross section, the number of notches and thus the predetermined bending point can be advantageously influenced. The lock can contain one or two pawls. Apart from an intermediate closed position the lock can also contain a fully closed position in which the locking mechanism can be locked. The rotary latch can thus contain one or two locking surfaces for locking. The lock can contain a blocking lever, blocking the pawl in the detent position. The rotary latch can initiate an opening, a closing or no torque in the pawl in the detent position.

This arrangement prevents the locking surface of the rotary latch from being released from the locking surface of the pawl due to deformations caused by excessive loads of, for instance 10 kN to 30 kN resulting in an unplanned opening of the locking mechanism. In one embodiment the collecting arm is, in particular, buckled in relation to the load arm as a result of excessive loading so that an overlap or an increased overlap between rotary latch and pawl is produced. The bending generally increases the distance between the two free ends of the collecting arm and load arm.

This embodiment also provides a tolerance compensation. A planned overlap of the locking surfaces of the pawl and rotary latch can have been reduced over the life of the lock due to greater tolerances at the support points of rotary latch and pawl and/or due to deformations of supported plastic parts. There is still no threat of an unplanned opening of the locking mechanism in case of excessive stresses as the overlap between the rotary latch and pawl would generally increase.

In particular, the tappet only moves the pawl out of its detent position when the pawl is not moved out of its detent position by an initiated opening moment. In order to ensure that in a respective embodiment the release lever does not only move a blocking lever away from the pawl but also the pawl out of the engagement area of the rotary latch, the release lever must be regularly pivoted by more than 10°. Only once the release lever has been pivoted by more than 10° does a tappet, generally attached to the release lever interact with the pawl, causing the pawl to be mechanically pivoted by the release lever. The tappet thus ensures that the pawl is moved out of its detent position when the opening mechanism fails due to the initiated opening torque.

In one embodiment the locking mechanism contains an intermediate closed position pawl, preferably also acting as the release lever. In this embodiment, in particular, the rotary latch preferably contains an arm for locking in the intermediate closed position, separated by a recess from the generally deformable arm with the locking surface. In the intermediate closed position, an arm of the pawl, preferably of an intermediate closed position pawl rests against this arm of the rotary latch, in order to lock the rotary latch in the intermediate closed position. This embodiment allows the provision of a predetermined bending point on the collecting arm as well as the provision of a locking surface for the intermediate closed position pawl at the desired point. This arm for the intermediate closed position pawl extends, in particular, past the level provided by the surface area of the rotary latch. This allows the provision of a release lever for the intermediate closed position above the pawl, also forming an intermediate closed position pawl.

In one embodiment, the locking mechanism contains a blocking lever that can block the pawl in its detent position. The pawl is unable to leave its detent position if it is blocked by the blocking lever. The locking mechanism can be particularly reliably locked by the blocking lever.

In order to achieve an even more compact design with fewer parts, the pawl and release lever of the locking mechanism are in one embodiment rotatably mounted on a common axis.

Advantageously, the rotary latch is pretensioned by a spring in the direction of the opening position of the lock, in order to be able to initiate a moment in the pawl even without the presence of a door sealing pressure.

In one embodiment of the invention the release lever can move a blocking lever of the locking mechanism out of its blocking position. For this purpose, generally a relatively low force suffices. Where the pawl is subsequently moved out of its detent position by an opening moment initiated in the pawl by the rotary latch, the overall force required for opening the locking mechanism is advantageously very low.

One embodiment provides a spring for moving the blocking lever into its blocking position. The blocking lever can thus be simply and reliably moved into its blocking position by the spring. In one embodiment the blocking lever and pawl are designed in such a way that by moving the blocking lever in its blocking position the pawl is also moved into its detent position. The number of required parts is thus reduced further. At the same time both the weight and required space are also reduced.

In one embodiment, the release lever contains three lever arms. Using a first lever arm, a blocking lever is, in particular, moved out of its blocking position for unlocking the locking mechanism. A second lever arm of the release lever preferably releases the pawl in the described manner, i.e. the spring force able to move the pawl in the direction of the locking position is at least reduced during opening of the locking mechanism. Preferably, this second lever arm contains a tappet for moving the pawl out of its locked position, providing a compact and simply to produce design. The third lever arm is used for activating the release lever i.e. for instance with the aid of a rod arrangement or Bowden cable and preferably with the aid of a connected handle or an electric drive. If the handle is actuated or the electric drive is started, this also actuates the third lever arm and the release lever for unlocking the locking mechanism and said release lever is, in particular, pivoted around an axis. Advantageously, the invention also provides a stop for the second lever arm in order to minimize the required space and weight and prevent the release lever from being moved past a desired end position.

Preferably, the pawl contains two lever arms with one lever arm locking the rotary latch. A mechanism, such as a pretensioned spring acts on the other lever arm, in order to be able to move the pawl into its detent position with the aid of a mechanism, such as a pretensioned spring. This other lever arm of the pawl is optionally engaged by a tappet of the release lever to unlock the locking mechanism and is moved accordingly and is, in particular, pivoted around an axis. Advantageously also a stop is provided for this lever arm in order to prevent the pawl from being moved past its full detent position.

A blocking lever for blocking the pawl in its detent position includes preferably two lever arms. A first lever arm of the blocking lever can, in particular, block the pawl in its latched position and/or move the pawl into its latched position. In one embodiment, in particular, this first lever arm can also be advantageously engaged by the release lever and moved out of its blocking position by pivoting, in particular, around an axis. The second lever arm of the blocking lever can preferably be moved against a stop so that the blocking lever can be moved past a provided end position. The provision of a second lever arm also advantageously contributes to the centre of gravity of the blocking lever being moved in the direction of the axis around which the blocking lever can be pivoted. This movement of the centre of gravity facilitates pivoting of the blocking lever.

In one embodiment, the blocking lever can also function as the release lever in order to minimize the number of components. In one embodiment the release lever also functions as an intermediate closed position pawl that can lock the rotary latch in the intermediate closed position. The locking mechanism can then lock a door or flap. It is, however, not as yet locked as planned in the fully closed position. Starting from the intermediate locked position, the fully closed position is only reached if the rotary latch is pivoted further in the direction of the locked position.

A locking mechanism of the invention is, in particular, arranged on a metal lock plate or on a lock casing generally made of metal. Usually, such a lock also contains a lock housing, generally made of plastic and which can protect components of the lock against external influences. The arrangement can also contain a lock cover made, in particular, from plastic and/or, in particular, a plastic cover for a central locking also provided for protection. The lock can, for instance, be part of a door or flap of a building or of the door or a flap of a motor vehicle.

The invention also includes such a lock with a pawl for the fully closed position of the rotary latch (also referred to as "fully closed position pawl" and a pawl for the intermediate closed position of the rotary latch (also referred to as "intermediate closed position") and advantageously also a blocking lever for said fully closed position pawl. Such a lock is disclosed in publication DE 10 2008 061 524 A1. A lock of the invention can, however, in addition to the blocking lever, also include only one pawl for locking the rotary latch in an intermediate locked position and a fully closed position.

The rotary latch contains a fork-shaped inlet slot, entered by a locking bolt of a door or flap when the vehicle door or flap is closed. The locking bolt then pivots the rotary latch from an opening position into a detent position. Once in the detent position, the locking bolt can no longer move out of the rotary latch. The pawl locks the rotary latch in the detent position so that it cannot be turned back into the open position.

A lock according to the invention contains components such as pawl, blocking lever or rotary latch that can and should be pivoted. Such arrangements regularly contain at least one pretensioned spring, in particular a leg spring, used for producing the desired pivoting movement of such a component as a result of the force of the spring. Such a pretensioned spring can, for instance, move a pawl into its detent position, a blocking lever into its blocking position or a rotary latch into its open position.

FIG. 1 shows: a locking mechanism in its locked state

FIG. 1 shows a locking mechanism of a lock of a motor vehicle, comprising a rotary latch, a pawl 2 and a blocking lever 3 that are rotatably mounted on a lock case 4. The rotary latch 1 can be pivoted around its axis 5. The pawl 2 can be pivoted around its axis 6. The blocking lever 3 can be pivoted around its axis 7. It must be noted that the invention is explained with reference to a lock consisting of several pawls, a so-called multiple pawl locking mechanism. The invention does, however, expressly not only relate to a multiple pawl locking mechanisms but is also applicable to all other locks with a locking mechanism.

Using its locking surface 8, the pawl 2 locks the rotary latch 1, resting with the locking surface 9 of its collecting arms 10 on the locking surface 8 of the pawl. In the example, an arrangement of the locking surface 8, 9 to each other has been chosen that ensures that the rotary latch 1 initiates an opening moment in the pawl 2. As a result of the opening moment, the pawl 2 can be pivoted out of its shown detent position and, in case of FIG. 1 by pivoting in clockwise direction around the axis 6 when the blocking lever 3 is moved out of its blocking position by actuation of an internal or external actuation means.

The rotary latch 1 contains a collecting arm 10 and a load arm 11. The collecting arm 10 contains a predetermined bending point 12. The tapered area can be provided in form of a preferably curved recess extending from one side or, as shown, from both sides of the collecting arm. When an excessive force as for instance in case of a crash is exerted on the locking bolt 13 held by the rotary latch 1 and the load arm 11 is thus pulled in the opening direction, the collecting arm 10 bends around the predetermined bending point 12 as a result of the predetermined bending point 12 and in relation to load arm 10 in counterclockwise direction. This deformation can be plastic and/or elastic. As a result, the contact point between the locking surface 9 and locking surface 8 is moved in such a way that the overlap of locking surfaces 8 and 9 is increased.

The rotary latch 1 contains an arm 14, extending into a plane located above the plane on which the bases of the rotary latch 1 and of the pawl 3 are located. Above pawl 2 a release lever—not shown—is provided on the axis 6 that also operates as an intermediate closed position pawl. In the intermediate closed position this arm 14 rests against the intermediate closed position pawl so that the locking mechanism can also be locked in an intermediate closed position. In this example of the embodiment the intermediate closed position arm 14 is a folded edge formed integrally with the rotary latch 1. It is, however, also possible to use an intermediate closed position arm 14 that is a separate bolt connected to the rotary latch 1. The rotary latch 1 can also contain an arm 15 that can, for instance, be moved against a stop in order to prevent excessive pivoting of the rotary latch.

The collecting arm 10 does not necessarily have to contain a tapered area, i.e. a recess 12 in order to be deformed in the desired manner. Alternatively also one or two recesses can be provided on one or both sides of the rotary latch. As a further alternative or, in addition, the rotary latch can also have undergone heat treatment, in order to form a predetermined bending point. It is therefore particularly important that the rotary latch is designed in such a way that in case of excessive stressing by the locking bolt 13, the rotary latch is deformed in such a way that the overlap of locking surfaces 8 and 9 is at least not reduced. Preferably, the overlap is even increased in case of excessive stressing. FIG. 1 shows a pretensioned leg spring 16, able to move the blocking lever 3 in the direction of the blocking position. The blocking lever 3 must be pivoted in counterclockwise direction and against the force of this spring 16 around its axis 7, in order to open the locking mechanism. The blocking lever 3 and pawl 2 are designed in such a way that the blocking lever 3 can move the pawl 2 into its detent position. A stop 17 mounted on lock case 4 prevents the pawl 2 from being moved in counterclockwise direction past its detent position.

In a further advantageous embodiment, a recess 18 is additionally or exclusively provided that is arranged in the collecting arm 10 of the rotary latch 1 on the side facing the locking bolt 13. This produces a relatively long physically effective lever without having to increase the overall design accordingly and in comparison to the scenario in which a recess in form of an indentation is provided on the side facing away from the locking bolt. In case of excessive stressing of the lever, the overlap then increases significantly. An indentation exists where starting from the open position, the locking bolt has to be moved over a step-like section 19 of the contour of the collecting arm 10, in order to move into the closed position shown in FIG. 1.

LIST OF REFERENCE NUMBERS

1: Rotary latch
2: Pawl
3: Blocking lever
4: Lock case
5: Pawl axis
6: Common axis of pawl and release lever
7: Blocking lever axis
8: Locking surface of pawl
9: Locking surface of rotary latch
10: Collecting arm
11: Load arm
12: Predetermined bending point
13: Locking bolt
14: Arm for locking in intermediate closed position
15: Arm
16: Leg spring
17: Stop for blocking lever
18: Indentation
19: Step-like contour

The invention claimed is:

1. A lock for a door or flap comprising a locking mechanism that has an unlocked position and a locked position, the locking mechanism comprising:

a rotary latch having a load arm, a predetermined bending point, a collecting arm that is spaced from the load arm and bendable around the predetermined bending point, a stop arm for preventing excessive pivoting of the rotary latch, and an intermediate closed position arm positioned between the collecting arm and the stop arm; and at least one pawl for locking the rotary latch, each of the collecting arm of the rotary latch and the pawl having a locking surface, the locking surface of the collecting arm and the locking surface of the pawl being engageable with one another to form a deformable overlapping surface area when in the locked position, wherein during excessive stressing of the locking mechanism when in the locked position, the collecting arm bends around the bending point and the locking surface of the rotary latch is deformable to maintain or increase the overlapping surface area between the pawl and the collecting arm of the rotary latch to maintain the locking mechanism in the locked position, wherein a distance between the collecting arm and the load arm of the rotary catch increases when the collecting arm bends around the bending point.

2. The lock according to claim 1, wherein the predetermined bending point is arranged on the collecting arm and contains a recess arranged on a side of the collecting arm facing away from a locking bolt of the door or flap in the locked position.

3. The lock according to claim 2, wherein the rotary latch contains at least two recesses and the recesses have equal or different lengths.

4. The lock according to claim 1, wherein at least one material property of the rotary latch is different at the predetermined bending point of the rotary latch as compared with the load arm and the collecting arm.

5. The lock according to claim 1, wherein the rotary latch contains at least one portion having a reduction in thickness.

6. The lock according to claim 5, wherein the reduction in thickness is on at least one side of the rotary latch.

7. The lock according to claim 5, wherein the rotary latch contains at least two portions having a reduction in thickness.

8. The lock according to claim 5, wherein the reduction in thickness has the shape of at least one of a pointed notch, a radius and a U-shape.

9. The lock according to claim 8, further comprising a blocking lever that blocks the pawl in the locked position of the locking mechanism.

10. The lock according to claim 4, wherein the at least one material property includes at least one of elasticity, bending stiffness, and hardness.

11. The lock according to claim 1, wherein the intermediate closed position arm is a bolt connected to the rotary latch.

12. The lock according to claim 1, wherein the predetermined bending point is located between the intermediate closed position arm and the collecting arm.

13. The lock according to claim 1, wherein the pawl contains two lever arms, one of the two lever arms being configured to engage the rotary latch.

14. The lock according to claim 13, wherein the two lever arms are arranged perpendicularly to one another.

15. A lock for a door or flap comprising a locking mechanism that has an unlocked position and a locked position, the locking mechanism comprising:

a rotary latch having a load arm, a predetermined bending point, and a collecting arm that is spaced from the load arm and bendable around the predetermined bending point; and at least one pawl for locking the rotary latch, the collecting arm of the rotary latch and the pawl having an overlapping surface area when in the locked position, wherein the pawl contains two lever arms, one of the two lever arms being configured to engage the rotary latch, wherein the two lever arms are arranged perpendicularly to one another, wherein during excessive stressing of the locking mechanism when in the locked position, the collecting arm bends around the bending point to maintain or increase the overlapping surface area between the pawl and the collecting arm of the rotary latch, causing a distance between the collecting arm and the load arm of the rotary catch to increase to maintain the locking mechanism in the locked position.

16. The lock according to claim 15, wherein the predetermined bending point is arranged on the collecting arm and contains a recess arranged on a side of the collecting arm facing away from a locking bolt of the door or flap in the locked position.

17. The lock according to claim 16, wherein the rotary latch contains at least two recesses and the recesses have equal or different lengths.

18. The lock according to claim 15, wherein at least one material property of the rotary latch is different at the predetermined bending point of the rotary latch as compared with the load arm and the collecting arm.

19. The lock according to claim 15, wherein the rotary latch contains at least one portion having a reduction in thickness.

20. The lock according to claim 19, wherein the reduction in thickness is on at least one side of the rotary latch.

* * * * *